US008316942B2

(12) United States Patent
Brown et al.

(10) Patent No.: US 8,316,942 B2
(45) Date of Patent: Nov. 27, 2012

(54) ESP FOR PERFORATED SUMPS IN HORIZONTAL WELL APPLICATIONS

(75) Inventors: Donn J. Brown, Broken Arrow, OK (US); B. L. Wilson, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 347 days.

(21) Appl. No.: 12/533,852

(22) Filed: Jul. 31, 2009

(65) Prior Publication Data

US 2011/0024123 A1 Feb. 3, 2011

(51) Int. Cl.
*E21B 43/14* (2006.01)

(52) U.S. Cl. ..... 166/313; 166/369; 166/106; 417/423.3; 417/366

(58) Field of Classification Search ..... 166/385, 166/370, 77.51, 66.4, 313, 369, 106; 175/61; 417/53, 45, 422, 423.3, 366
See application file for complete search history.

(56) References Cited

U.S. PATENT DOCUMENTS 5,845,709 A 12/1998 Mack et al.
5,881,814 A * 3/1999 Mills ..... 166/313
6,033,567 A * 3/2000 Lee et al. ..... 166/265
6,056,511 A 5/2000 Kennedy et al.
6,131,655 A * 10/2000 Shaw ..... 166/105.5
6,579,077 B1 6/2003 Bostwick et al.
6,615,926 B2 9/2003 Hester et al.
6,622,791 B2 * 9/2003 Kelley et al. ..... 166/313
6,684,946 B2 2/2004 Gay et al.
6,691,781 B2 2/2004 Grant et al.
6,691,782 B2 2/2004 Vandevier
6,702,027 B2 3/2004 Olson et al.
6,851,935 B2 2/2005 Merrill et al.
7,055,606 B2 * 6/2006 Goode et al. ..... 166/369
7,316,268 B2 * 1/2008 Peleanu et al. ..... 166/68.5
7,828,059 B2 * 11/2010 Reid et al. ..... 166/250.15
2006/0245957 A1 11/2006 Berry et al.
2009/0272129 A1 * 11/2009 Petty ..... 62/64
2010/0150739 A1 * 6/2010 Brookbank et al. ..... 417/53

* cited by examiner

*Primary Examiner* — David Andrews
*Assistant Examiner* — Richard Alker
(74) *Attorney, Agent, or Firm* — Bracewell & Giuliani LLP

(57) ABSTRACT

The present invention relates to a process for cooling an electrical submersible pump. More specifically, the invention relates to blocking a portion of wellbore fluid from entering a sump, thereby causing the pump to draw fluid from below the pump motor past the exterior of the pump motor toward a pump inlet.

9 Claims, 3 Drawing Sheets

ESP FOR PERFORATED SUMPS IN HORIZONTAL WELL APPLICATIONS

BACKGROUND OF THE INVENTION

1. Field of the Invention

The present invention relates to an apparatus and method for cooling an electrical submersible pump. More specifically, the invention relates to cooling the motor of an electrical submersible pump by drawing fluid from a wellbore sump along the motor.

2. Description of the Related Art

Electrical submersible pumps ("ESP") are used to pump fluids up from a wellbore. Wellbore fluids may include oil, natural water, or water drive fluid. Water drive fluid is fluid that is injected into a rock formation under pressure and is used to push, or drive, minerals such as oil or gas towards a wellbore. The water drive fluid enters the wellbore along with the minerals and must be pumped out with the minerals.

The motor used to drive the ESP pump generates heat and thus the motor must be cooled to prolong the life of the motor. Because the ESP is generally submerged in fluid in the wellbore, one method of cooling the motor is to transfer heat from the motor to the fluid surrounding the motor. Heat transfer from the motor to the surrounding fluid is more efficient when fluid is flowing across the outside of the motor housing. The pump, which is located above the motor in the wellbore, can be used to draw wellbore fluid up from below the motor, along the motor housing, and into the pump inlet. In some conditions, the fluid surrounding the motor remains static, resulting in poor heat transfer.

One such condition may occur with a horizontal well in a gassy formation. The ESP may be used to dewater the formation or simply pump wellbore fluids up to the surface. Though used in a gassy formation, ESPs may not be able to handle high concentrations of gas or pockets of gas. Therefore, the ESP may be located in a sump below the horizontal well to avoid any gas pockets that may form. A sump is a branch of the wellbore drilled at an angle off of the horizontal wellbore. The sump allows for a natural separation of the fluids, providing an area for the liquid to flow down to and be produced by the ESP while the gas continues to rise up the annulus of the well. The sump may also have perforations for fluid to directly enter the sump.

The fluid in the sump may not have adequate flow to cool the ESP motor. Fluid enters the sump from two directions—down from the horizontal wellbore and up from perforations in the bottom of the sump. If the pressure from the horizontal wellbore is higher than the pressure from the perforations in the bottom of the sump, the majority of the fluid flowing to the pump inlet is coming from above the pump. The motor, being located below the pump, sits in stagnant fluid. Heat transfer to stagnant fluid is less efficient, resulting in overheating of the pump motor.

SUMMARY OF THE INVENTION

The motor may be cooled by incorporating a small intermediate pump between the motor/seal and the primary pump. The intakes of the primary pump and the intermediate pump are separated by a cup seal or packer between the housing of the intermediate pump and the inner diameter of the wellbore. The seal closes off the annulus of the casing and thus isolates the two intakes. The intake above the packer draws fluid from the main wellbore, such as the horizontal wellbore. The intermediate pump pulls cooling fluid from the sump perforations, past the motor housing, and into the intermediate pump's inlet. The intermediate pump then discharges the fluid into the base of the upper pump.

In an alternative embodiment, only a single pump is used. A packer is used to isolate the lower end of the sump from the rest of the wellbore. The primary pump inlet is located on the sump side of the packer. A bypass tube through the packer permits fluid from the horizontal wellbore, above the packer, to pass through the packer to the sump. The fluid from the bypass tube co-mingles with the fluid from the sump perforations, flows over the motor and in to the pump intake. The bypass tube may be sized to induce flow resistance in the bypass tube and thus encourage greater flow from the sump perforations.

In another alternative embodiment, the ESP is again located in a sump. A shroud is located around the motor and attached to the outer diameter of the pump, just above the pump inlet. The outer diameter of the shroud is sized to occlude the majority of the wellbore. The pump is able to pump a volume of fluid that is greater than the volume of fluid that can flow between the wellbore and the shroud in a given period of time. Thus the pump draws fluid from the sump perforations into the inlet, along with whatever amount of fluid is able to bypass the shroud.

BRIEF DESCRIPTION OF THE DRAWINGS

So that the manner in which the above-recited features, aspects and advantages of the invention, as well as others that will become apparent, are attained and can be understood in detail, more particular description of the invention briefly summarized above may be had by reference to the embodiments thereof that are illustrated in the drawings that form a part of this specification. It is to be noted, however, that the appended drawings illustrate only preferred embodiments of the invention and are, therefore, not to be considered limiting of the invention's scope, for the invention may admit to other equally effective embodiments.

DETAILED DESCRIPTION OF THE EXEMPLARY EMBODIMENTS

Figure 1:
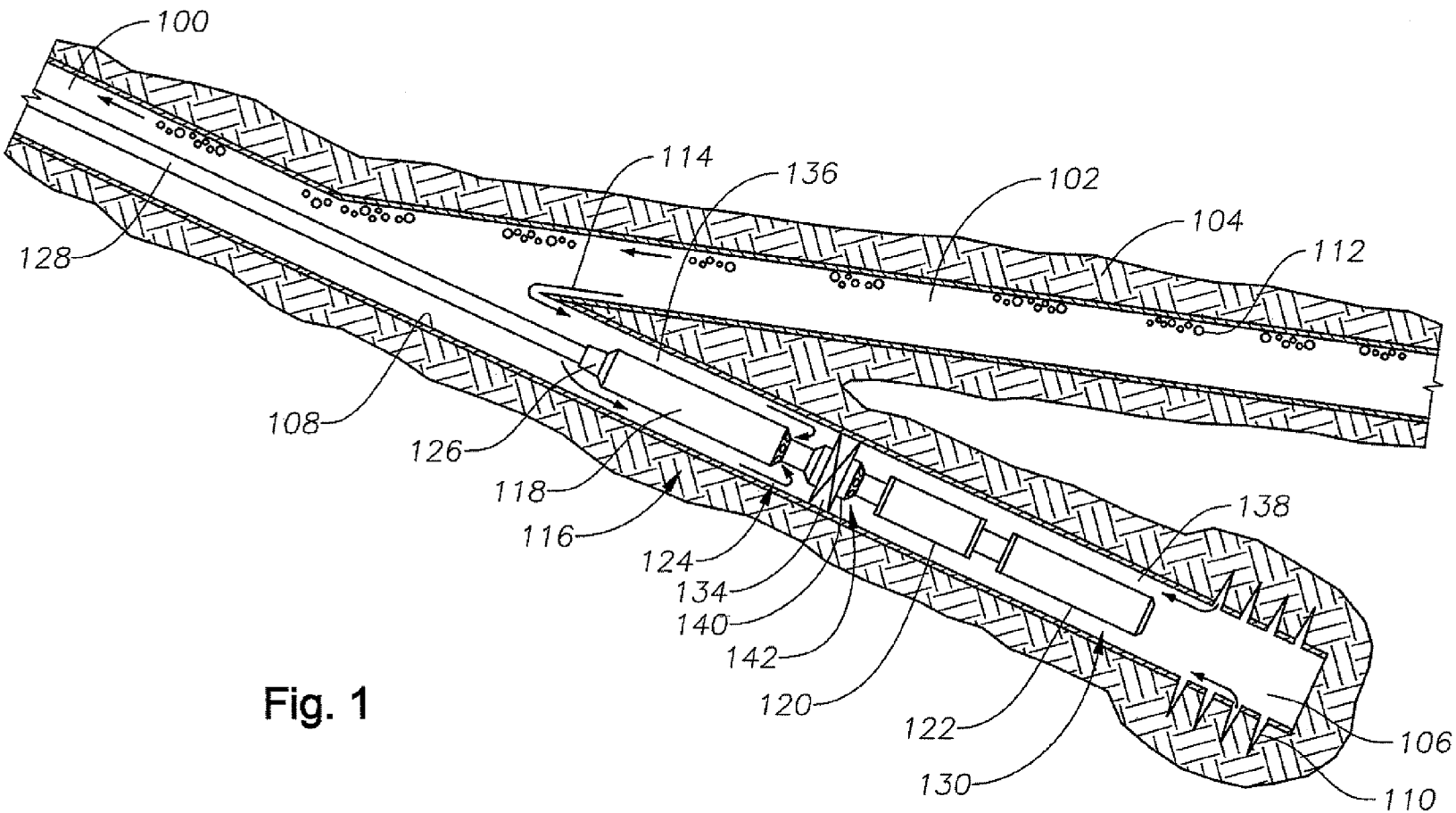
FIG. 1 is a side view of an exemplary embodiment of an electrical submersible pump having dual intakes with a packer.

Referring to FIG. 1, wellbore 100, having horizontal branch 102, is drilled through subterranean formation 104. Sump 106 is drilled below horizontal branch 102 and generally has an orientation that is more vertical than horizontal branch 102. Sump 106 is generally defined as a low point below main wellbore 100 or horizontal wellbore 102. It is created by extending the descending wellbore 100 below the point where the descending wellbore 100 changes direction to a more horizontal orientation. Alternatively, sump 106 may be a descending branch below a horizontal section 102 of wellbore 100. The deepest part of sump 106 is generally deeper than the horizontal branch 102 associated with sump 106. In this example, sump 106 is co-axial with the upper portion of wellbore 106.

Casing 108 lines the wellbore of both horizontal branch 102 and sump 106. The casing in sump 106 may have perforations 110 to allow water to pass through casing 108 from rock formation 104 into sump 106. Horizontal branch 102 also has perforations (not shown). As oil, gas, and water flow through casing 108 into horizontal branch 102, gas 112 tends to float upward through branch 102 and into the upper portion of wellbore 100. Liquids 114 tend to flow from horizontal branch 102 down into sump 106. Liquids 114 flowing out of horizontal branch 102 may be production fluid, such as oil, natural water from a water drive well, or water that was injected into a different part of the rock formation for the sake of pushing gas or oil through the rock formation and into the wellbore. Electrical submersible pump ("ESP") 116 may be located in sump 106 to pump liquid 114 out of wellbore 100.

Referring to FIG. 1, sump 106 is shown in an inclined orientation, but it could be vertical. ESP 116 is situated inside sump 106. ESP 116 comprises pump 118, seal section 120, and motor 122. Pump 118 may be centrifugal or any other type of rotary pump and may have an oil-water separator or a gas separator. Pump 118 is driven by a shaft (not shown) operably connected to motor 122. Pump 118 has an inlet 124 for drawing fluid into pump 118, and an outlet 126 that discharges fluid into tubing 128. Seal section 120 is mounted between motor 122 and pump 118. Seal section 120 reduces the pressure differential between lubricant in motor 122 and the well fluid surrounding ESP 116. Motor 122 is generally an electric motor encased in a housing 130. Motor 122 may generate a substantial amount of heat as it pumps a large volume of fluid up through wellbore 100. Because ESP 116, including motor 122, is submerged in wellbore fluid, heat may be dissipated by transferring heat to the surrounding fluid.

An intermediate pump 140 may be located between motor 122 and primary pump 118, on the sump end 138 of wellbore 100. The shaft (not shown) from the motor 122 passes through the intermediate pump 140, or is coupled to a shaft (not shown) in the intermediate pump 140. Intermediate pump 140 has one or more inlets 142 for drawing fluid from sump 106. Fluid drawn in by inlet 142 is discharged into the base of primary pump 118. The discharge (not shown) may flow directly into the interior of the primary pump 118, thus making the primary pump 118 act as the second stage of a two stage pump.

In an exemplary embodiment, a packer 134 is located on the outer diameter of pump 140 above inlet 142 and below inlet 124 of pump 118. Packer 134 is a device used to isolate one section of a wellbore from another section of the wellbore and thus is a wellbore obstructer. Any type of wellbore seal may be used for packer 134, including, for example a cup seal, inflatable packer, or expandable elastomeric packer. Packer 134 has a bore or orifice that forms a seal around pump 140. The outer diameter of packer 134 forms a seal against the inner diameter of casing 108 in sump 106. By sealing against both the pump 140 and wellbore 100, packer 134 isolates the section of wellbore above packer 134 from sump wellbore 106 below packer.

For descriptive purposes, packer 134 divides the sump into two sections—wellbore end 136 and sump end 138. Wellbore end 136 is located within sump 106 and is in communication with horizontal wellbore 102. Sump end 138 is the end of sump 106 where the sump leg of wellbore 100 terminates. Packer 134 generally isolates sump end 138 from wellbore end 136, even though some fluid communication may occur between the ends.

Intermediate pump 140 pulls sump fluid across surface 130 of motor 122 regardless of the pressure differential between the sump end 138 fluid and horizontal wellbore 102 fluid 114. The fluid drawn past motor 122, by intermediate pump 140, is not re-circulated fluid and thus has not been heated by initially moving through a recirculation pump. Intake 124 of pump 118 pumps fluid 114 that flows down from horizontal branch 102 as well as the fluid delivered to pump 118 by pump 140. In an alternative embodiment, the fluid from pump 140 may be discharged into the wellbore end 136 on the upper side of packer 134. Pump 118 would pump that fluid up tubing 128 also.

Figure 2:
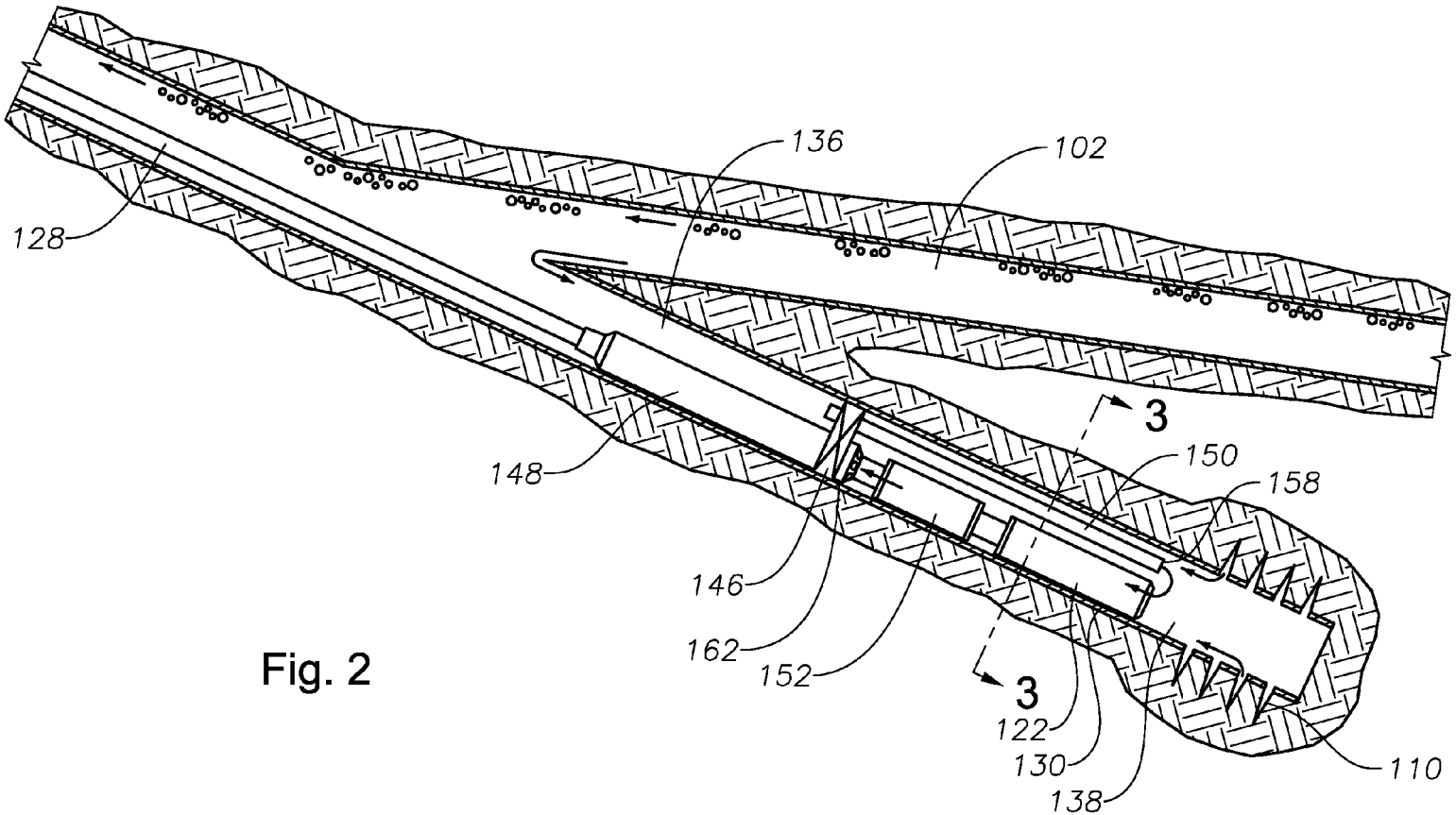
FIG. 2 is a side view of an exemplary embodiment of an electrical submersible pump having a bypass tube.
Figure 4:
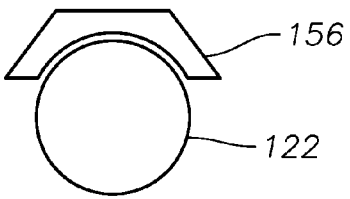
FIG. 4 is a cross sectional view, taken along the 3-3 line, of an alternative embodiment of the electrical submersible pump of FIG. 2.
Figure 3:
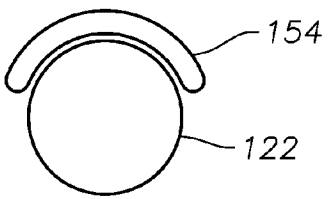
FIG. 3 is a cross sectional view, taken along the 3-3 line, of an alternative embodiment of the electrical submersible pump of FIG. 2.

Referring to FIG. 2, in an alternate embodiment, a packer 146 is located on the outer diameter of pump 148, which is the only pump in this embodiment. Packer 146 isolates the lower end 138 of sump wellbore from the wellbore end 136, located near horizontal wellbore 102, and thus packer 146 serves as a wellbore obstructer. A bypass tube 150 passes through, and is sealed against, an orifice in packer 146. Bypass tube 150 has an open upper end to receive fluid flowing from horizontal branch 102 down to the upper end of packer 146. Bypass tube 150 may be any diameter or shape, depending on the diameter of wellbore 100 and sump 106, and the size of ESP motor 122 and seal section 152. Bypass tube 150 could be, for example, a round tube or pipe. The bypass tube 150 diameter could be any diameter including, for example, 1 to 3 inches. The tube 150 could be larger or smaller depending on the diameter of the wellbore 100 and sump 106. Bypass tube 150 may have a shape that is not cylindrical such as, for example, a c-shape 154 (FIG. 3) or a modified trapezoid shape 156 (FIG. 4). Bypass tubes 150 with non-cylindrical shapes 154, 156 may be especially useful when the diameter of wellbore 100 is too small to accommodate the diameter of a cylindrical bypass tube 150 located adjacent to ESP motor 122. Tube outlet 158 is located on the sump end 138 of packer 146. Tube outlet 158 may extend axially to the end of motor 122, or it may terminate at an axial location above or below the end of motor 122. In an exemplary embodiment, bypass tube 150 extends from a point on the wellbore side 136 of packer 146, through packer 146, to a point adjacent to the distal end of motor 122. In some embodiments, tube outlet 158 may have a diffuser to disperse fluid as it exits bypass tube 150. Some embodiments may use multiple bypass tubes 150.

Pump inlet 162 is located at the base of pump 148, on the sump end 138 of packer 146. In operation, inlet 162 draws fluid directly from sump 138. In the event pressure from horizontal wellbore 102 is higher than pressure from sump 138, fluid from horizontal wellbore 102 flows down through bypass tube 150 into sump 138. Horizontal branch 102 wellbore fluid then mixes with sump 106 fluid, and the combined fluids are drawn past motor 122 and into inlet 162. As fluid is drawn into inlet 162 and pumped out of wellbore 100 through tubing 128, additional fluid enters the lower sump wellbore 138, either through perforations 110 in the sump end 138 of wellbore 100 or through bypass tube 150. Fluid flows through bypass tube 150 solely because of pressure differential above and below packer 146. A recirculation pump is not used to force the fluid through the bypass tube 150 and thus the fluid is not heated by a recirculation pump prior to flowing across the exterior surface of motor housing 130.

In some embodiments, bypass tube 150 is sized to allow less fluid to pass through bypass tube 150 than is expected to be pumped by pump 148. In these embodiments, pump 148 draws at least some fluid from sump fluid—i.e. fluid flowing through wellbore perforations 110 in the sump 138.

Figure 5:
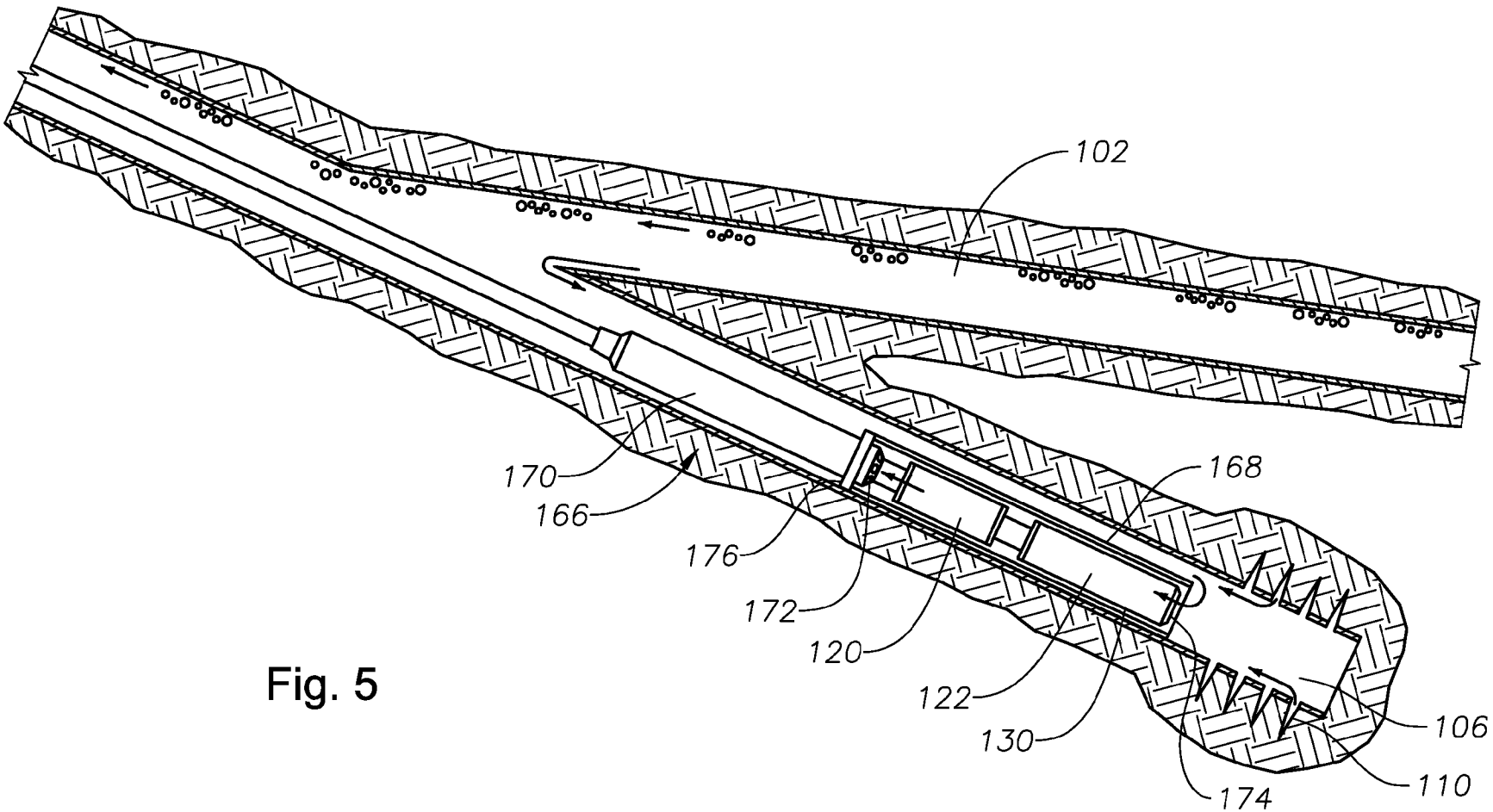
FIG. 5 is a side view of an exemplary embodiment of an electrical submersible pump having a shroud.

Referring to FIG. 5, ESP 166 is located in sump 106 below horizontal wellbore 102. ESP 166 comprises cylindrical shroud 168, wherein shroud 168 is attached to pump 170, above inlet 172. Shroud 168 has an open lower end 174 below motor 122 and an upper end 176 sealingly secured around pump 170 above inlet 172. Shroud 168 may be secured by other means and in other locations. As with conventional shrouds, wellbore fluid flows between motor 122 and shroud 168. Heat is transferred to fluid as it flows across the motor housing 130.

The outer diameter of shroud 168 may be sized to form an obstruction in sump wellbore 106, and thus serve as a wellbore obstructer. A small flow area exists between shroud 168 and the casing in sump 106. In these embodiments, the flow rate of fluid capable of passing between the OD of shroud 168 and the ID of sump wellbore 106 is less than the volume expected to be pumped by pump 170. Thus at least some fluid entering the inlet 172 of pump 170 must originate from sump casing perforations 110.

The exemplary embodiments of a dual intake ESP are described in the context of a sump having perforations. The embodiments are not limited to sumps having perforations, and may be used in any wellbore situation wherein fluid is drawn from both above and below the ESP.

While the invention has been shown or described in only some of its forms, it should be apparent to those skilled in the art that it is not so limited, but is susceptible to various changes without departing from the scope of the invention.

What is claimed is:

1. An apparatus for removing liquid from a well having an inclined branch that produces a branch produced liquid that flows into a sump, the sump producing a sump produced liquid, comprising:

an electrical submersible pump assembly adapted to be positioned in the sump so as to pump branch produced and sump produced liquids from the sump, the pump assembly comprising a first pump, a second pump, and a motor, the second pump being mounted in the pump assembly below the first pump and above the motor for drawing the sump produced liquid past the motor;

a flow ratio device mounted to the submersible pump assembly that controls a ratio of the branch produced and sump produced liquids pumped by the pump assembly to assure a desired flow of sump produced liquids past the motor for cooling, the flow ratio device comprising a seal surrounding the pump assembly below an inlet of the first pump and above the motor for sealing between the pump assembly and a side wall of the sump, preventing the flow of branch produced liquid below the inlet, and the second pump having a discharge above the seal in communication with the inlet of the first pump.

2. The apparatus according to claim 1, wherein the second pump discharges sump produced liquid directly into the inlet of the first pump.

3. The apparatus according to claim 1, wherein the second pump discharges sump produced liquid into the sump above the seal and surrounding the inlet of the first pump.

4. An apparatus for pumping fluid from a wellbore, the apparatus comprising:

a pump assembly comprising a first pump section, a second pump section, a motor, and a seal section, the first pump section and the second pump section both being driven by the motor;

an upper inlet located on the first pump section;

a lower inlet located on the second pump section;

a flow ratio device mounted to the pump assembly that controls a ratio of branch produced and sump produced liquids pumped by the pump assembly to assure a desired flow of sump produced liquids past the motor for cooling, the flow ratio device comprising a seal surrounding the pump assembly below the upper inlet and above the lower inlet for sealing between the pump assembly and a sidewall of a wellbore, the seal being located above at least a portion of the motor, wherein fluid drawn into the lower inlet originates from wellbore perforations located below the seal and wherein fluid drawn into the upper inlet originates from wellbore perforations located above the seal; and a single discharge located above the upper inlet, wherein fluid drawn into the first and second pump sections passes through the single discharge.

5. The apparatus according to claim 4, wherein the second pump section discharges fluid directly into the inlet of the first pump.

6. A method for removing liquid from a gas and liquid producing well, the well having an inclined branch and a sump, comprising:

(a) placing an electrical submersible pump assembly in the sump, the pump assembly comprising a first pump, a second pump, and a motor, the second pump being mounted between the first pump and the motor;

(b) flowing gas from the inclined branch into an upper section of the well and flowing a branch produced liquid from the inclined branch downward into the sump;

(c) flowing a sump produced liquid into the sump;

(d) operating the pump assembly and pumping the branch and sump produced liquids from the sump up the upper section of the well;

(e) preventing the flow of branch produced liquid below the inlet by setting a seal in an annulus surrounding the pump assembly below an inlet of the first pump and above the motor; and (f) controlling, with a flow ratio device comprising the seal surrounding the pump assembly, a ratio of the amount of branch and sump produced liquids being pumped to assure an adequate flow of sump produced liquid past the motor for cooling, by using the second pump to draw the sump produced liquid past the motor, pumping the sump produced liquid above the seal, and combining with the sump produced liquid above the seal with the branch produced liquid above the seal.

7. The method according to claim 6, wherein the second pump discharges sump produced liquid directly into the inlet of said first pump.

8. The method according to claim 6, wherein the second pump discharges sump produced liquid into the sump above the seal and surrounding the inlet of said first pump.

9. The method according to claim 6, wherein step (d) comprises pumping the liquids into a string of tubing extending up the upper section of the well to the surface.

* * * * *